United States Patent [19]

Presley

[11] 4,337,587

[45] Jul. 6, 1982

[54] VEHICLE POWER CONTROL SYSTEM

[76] Inventor: Glen T. Presley, 403 W. Stocker, Angola, Ind. 46703

[21] Appl. No.: 139,864

[22] Filed: Apr. 14, 1980

[51] Int. Cl.[3] ..... E02F 5/06

[52] U.S. Cl. ..... 37/83; 37/DIG. 1; 60/449; 60/468

[58] Field of Search ..... 37/86, 83, DIG. 1; 172/2, 3, 7; 56/10.2, DIG. 15; 60/449, 459, 468; 180/53 R, 306, 305, 170; 123/103 R

[56] References Cited

U.S. PATENT DOCUMENTS

| | | | |
|---|---|---|---|
| 3,750,762 | 8/1973 | Eaton | 37/86 X |
| 3,999,386 | 12/1976 | Crull et al. | 60/468 X |
| 4,180,979 | 1/1980 | Cornell | 60/449 X |
| 4,218,957 | 8/1980 | Underwood | 91/451 X |

*Primary Examiner*—Clifford D. Crowder
*Attorney, Agent, or Firm*—Edward L. Brown, Jr.

[57] ABSTRACT

An automatic horsepower control system on a working vehicle which varies the vehicle drive speed so as to maintain a maximum torque output on the working function of the vehicle. The prime mover of the vehicle drives the work function and also a pump which in turn supplies motor-driven wheels for moving the vehicle. A servo-control valve varies the pump flow to the motor to change vehicle speeds, said valve being signaled by an electronic controller which compares the prime mover's RPM with a standard to determine the torque load from the work function, and accordingly signals the valve to increase or decrease the flow to the motor to adjust vehicle speed and maintain a constant work load on the prime mover.

7 Claims, 2 Drawing Figures

VEHICLE POWER CONTROL SYSTEM

BACKGROUND OF THE INVENTION

For many years vehicles have been built wherein the prime mover drives the work function of the vehicle along with propelling the vehicle. Machines of this type would include trenchers, forage harvesters, tillage machines and any other type of machine which moves along as it performs its work function. In the case with most of these machines, and particularly a trencher, the machine does not have enough power to operate its digging mechanism while propelling the machine at its maximum ground speed. Therefore, the operator must listen to the engine, or watch the engine RPM while manually varying the ground speed of the trencher to keep the engine loaded, but at the same time not to overload the engine causing it to stall. This type of manually adjusted system has proven fairly successful, but requires a skilled operator to make constant speed correction to realize anywhere near optimum machine performance. A lesserskilled operator obviously cannot run the machine at anywhere near its peak capacity. Quite often the operator sets the ground speed at some value whereby the engine horsepower used is substantially less than the maximum, and lets the machine operate at this speed, thus not utilizing the full capabilities of the machine.

The present invention provides an automatic system wherein the ground speed of the vehicle is automatically regulated instantaneously so that the full horsepower capacity of the machine is utilized at all times, even though the resistance to digging is constantly changing. The control of the present invention adjusts the ground speed of the machine to keep the engine operating at a substantially constant horsepower at all times. As the digging mechanism encounters softer soil, the machine will increase its ground speed which in turn increases the load or torque on the engine. Likewise, when the digging mechanism engages harder soil it slows down its ground speed just enough to maintain an essentially constant RPM.

It is therefore a principal object of the present invention to provide an automatic horsepower control system which varies the vehicle speed so as to maintain a constant work load torque under varying conditions.

Another object of the present invention is to provide a trencher drive system which varies the vehicle speed in accordance with the digging resistance encountered.

The advantages and objects of the invention will become evident from the following detailed description of the drawings when read in connection with the accompanying drawings which ilustrate a preferred embodiment of the invention.

Figure 1:
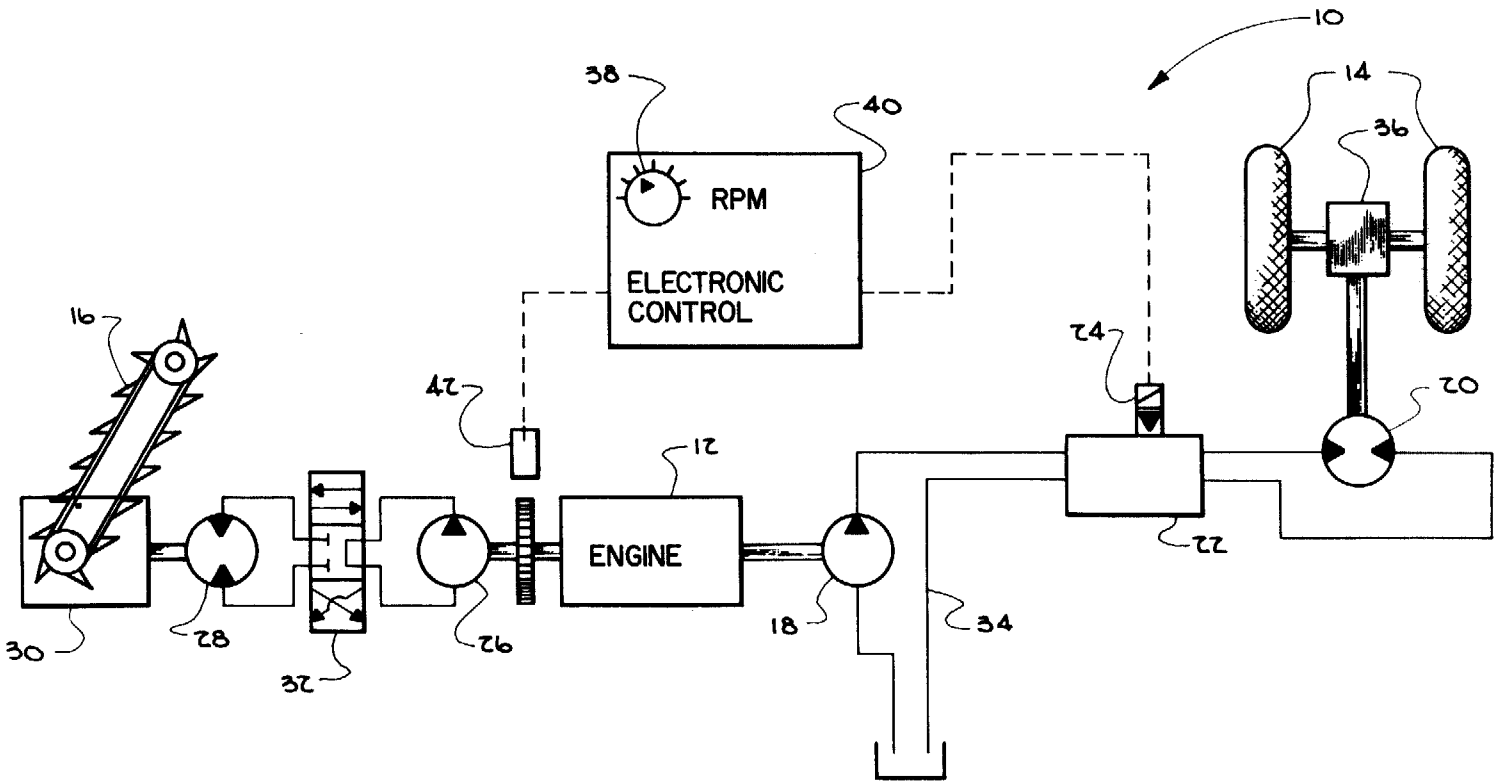
FIG. 1 is a schematic diagram of the horsepower control system of the present invention utilized on a trencher.

Turning now more particularly to FIG. 1, there is illustrated the horsepower control system of the present invention generally identified by reference numeral 10. The system includes a prime mover or engine 12 which drives the vehicle wheels 14 and the digging mechanism 16. Prime mover 12 drives a fixed displacement pump 18 which supplies a vehicle drive motor 20. Positioned between the pump 18 and motor 20, for controlling the vehicle drive speed, is a servo control valve means 22 which in turn is controlled by solenoid 24.

Prime mover 12 also drives the principal work function, which is digging chain 16 in the FIG. 1 embodiment, through a second pump 26 and digging motor 28. Motor 28 drives digging chain 16 through a conventional gear reduction box 30. The chain drive circuit, is a closed loop flowing through a conventional three-way valve 32 which either returns the flow to pump 26 or directs it to either side of motor 28 with the return from motor 28 flowing back to the return side of pump 26.

The vehicle speed is controlled by an open loop hydraulic circuit wherein pump 18 supplies valve means 22 which in turn supplies motor 20 with the remaining flow returning to tank through line 34. Wheel drive motor 20 in turn drives wheels 14 through a conventional gear box and differential 36. Valve means 22 is controlled by electrical signals from an electronic control 40 which includes an RPM reference 38. The prime mover or engine 12 has a sensor 42 located on the engine drive shaft for sensing RPM of the engine. Sensor 42 supplies an electrical signal to control 40, which in turn compares the actual RPM signal with a reference so as to determine the loading on engine 12. Sensor 42 could be either a magnetic type as well as various other types of commonly known speed sensors. While the trencher drive means is shown as a closed hydraulic circuit, it could also be a direct drive mechanical means through a gear box or chain drive.

FIG. 1 OPERATION

The resistance to digging chain 16 depends on a variety of factors including soil conditions, depth and most important horizontal speed through the ground. If the horizontal speed of the trencher is stopped, the digging chain 16 will merely pass through previously dug ground with the load on the chain diminishing substantially. As the horizontal digging speed is increased, the torque loading on digging chain 16 increases the faster it engages undisturbed earth.

Initially the trencher operator will set the mechanical throttle of engine 12 at an RPM which will be greater than the RPM level of reference 38. As the trencher begins to dig, motor 12 will slow down due to the digging load from chain 16. As long as the actual engine RPM stays at the reference 38, control valve 22 will direct a certain amount of flow to drive wheel motors 20 causing the trencher to move horizontally across the ground at a set speed. When the actual engine speed drops below the pre-set reference 38, valve 22 reduces the flow to motor 20 causing the vehicle to slow down which in turn lightens the loading on digging chain 16. The reduced loading on chain 16 allows the engine speed to increase until it reaches that of reference 38 at which time electronic control 40 signals valve 22 to increase the flow to motor 20 and in turn the vehicle speed. This electrically-sensed adjustment to the hydraulic system takes place very quickly, in a fraction of a second, much faster than any human adjustment could be made. With a set throttle speed on motor 12, and a pre-selected standard 38, the operator can set the trencher control system 10 to a constant horsepower output regardless of the terrain conditions encountered. Operating a trencher at its maximum horsepower output with a system of this nature can increase the output of the trencher thirty percent over that of any manually controlled trencher with a skilled operator. The speed of sensing and adjusting control valve 22 is so quick that the actual engine RPM will appear to the human ear to remain constant even through a wide range of digging conditions which are encountered.

Figure 2:
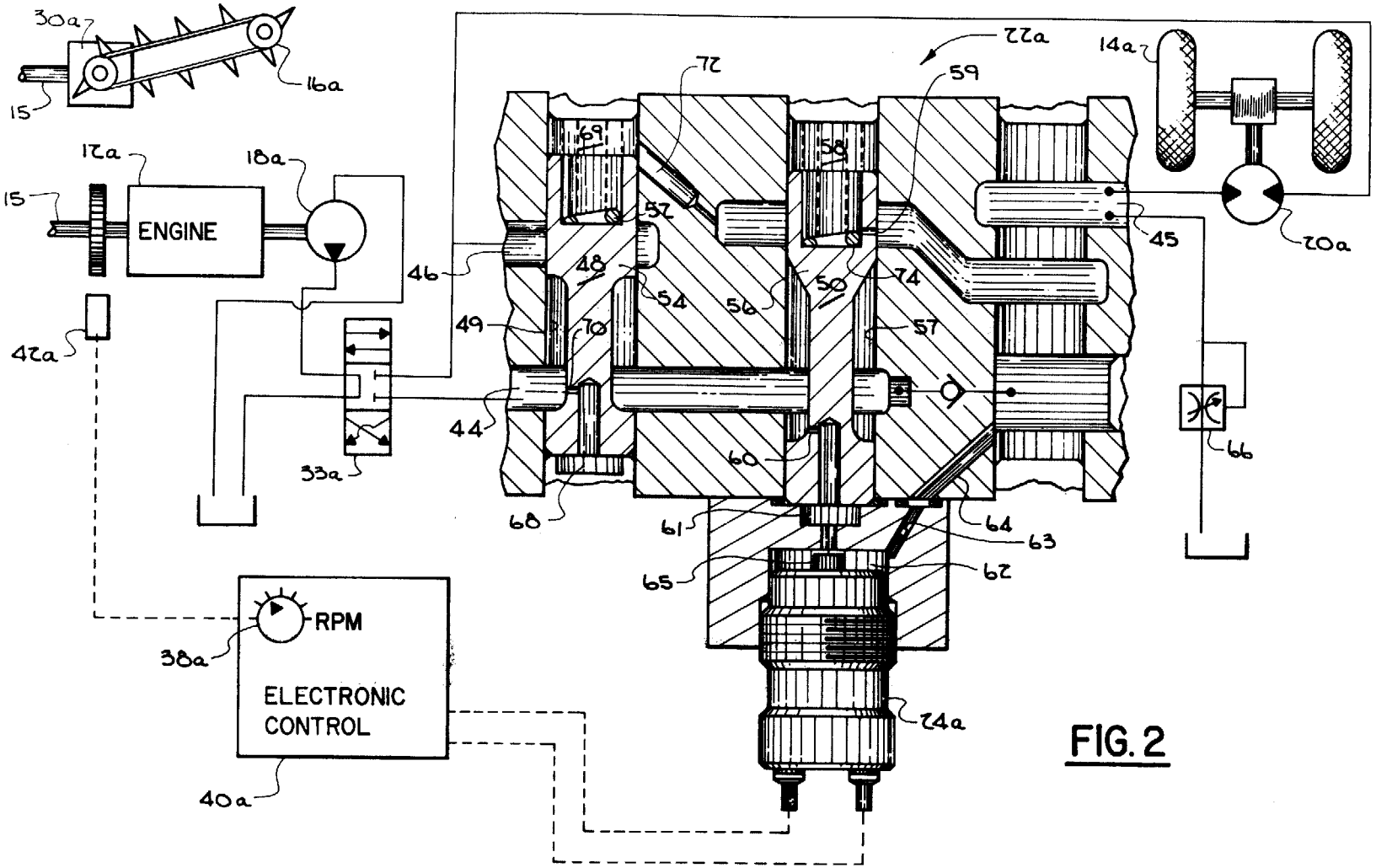
FIG. 2 is a partially schematic view of the system illustrating in detailed section, the control valve which propels the vehicle.

In FIG. 2, the servo-controlled valve 22*a* is shown in detail in conjunction with the overall control system. Prime mover or engine 12*a* drives a digging chain 16*a* through a direct mechanical drive shaft 15 and gear box 30*a*. Engine 12*a* also drives pump 18*a* which in turn hydraulically drives wheel motor 20*a* through three-way valve 33*a* and servo-control valve 22*a*.

Servo-controlled valve 22*a* includes an inlet port 44, motor port 45 and a drain port 46. Intersecting inlet port 44 is an unloading spool 48 and a corresponding bore 49. Spool 48 is urged downward by spring 52 towards a closed position with valve spool land 54 blocking flow from inlet 44 to drain port 46.

Located downstream from unloading spool 48 is a variable flow spool 50 positioned in a corresponding bore 57. Spool land 56 provides a variable orifice with spool bore 57 for controlling the rate of flow to vehicle drive motor 20*a*. The pressure downstream from spool land 56 is sensed on the top of spool 50 in cavity 58 via passage 59, while the pressure upstream of land 56 is felt on the opposite end of spool 50, via restricted flow passage 60 in cavity 61. Cavity 61 will always have a pilot flow therethrough to the downstream side of spool 50 via solenoid cavity 62, passages 63 and 64. The pressure in cavity 61 is controlled by energizing solenoid 24*a* which causes solenoid core 65 to restrict the flow out of cavity 61. In its unenergized unrestricting position, core 65 creates no back pressure or pressure drop in the pilot flow path, therefore the pressure in cavity 61 is zero with a pressure drop across restricted passage 60. The pilot flow through cavity 61 flows to drain across a flow limiter 66 which allows a very small flow to drain.

Unloading spool 48 experiences the valve inlet pressure at its bottom end in cavity 68 via passage 70 while the opposite end of spool 48 senses the pressure downstream from spool 50 via passage 72 and cavity 69. The function of unloading spool 48 is to maintain a constant pressure drop across land 56 of spool 50 regardless of the flow rate or pressure levels. By dumping the upstream pressure in port 44 to drain in passage 46, spool 48 controls the pressure drop across land 56. With no flow across spool 50, spool 48 will unload at whatever pressure is required to move spring 52.

FIG. 2 OPERATION

With solenoid 24*a* completely de-energized, there is no flow to drive motor 20*a*, since spring 74 is holding spool 50 in its closed position and there is no pressure build-up in cavity 61. The entire pump flow is passing through valve 33*a* into inlet port 44 with the inlet pressure in cavity 68 overcoming spring 52 causing spool 48 to shift upwardly opening the inlet port pressure to drain via drain port 46.

Initially, the prime mover or engine 12*a* has its throttle set at a certain unloaded position, at an RPM level above the selected level of standard 38*a*. As digging chain 16*a* initially engages the ground, with the trencher in a stationary position, the RPM of prime mover 12*a* will be sensed by controller 40*a* via sensor 42*a*. With light loads on the digging chain 16*a*, the engine RPM will be greater than the set standard 38*a* which will cause control 40*a* to partially energize solenoid 24*a*. As solenoid core 65 moves upwardly, a variable restriction is created in the pilot flow path downstream from cavity 61. This restriction causes a pressure build-up in cavity 61, moving spool 50 upwardly against spring 74 allowing flow to drive motor 20*a*, thereby commencing movement of the trencher. As long as the RPM of engine 12*a* stays above the standard 38*a*, solenoid 24*a* will continue to increase its restriction and in turn the speed of motor 20*a*, until engine 12*a* slows down due to the increased digging resistance to chain 16*a*.

When the digging resistance to chain 16*a* momentarily increases above the torque capacity of motor 12, the RPM sensed at 42*a* will drop below the standard at 38*a* which will cause control 40*a* to de-energize solenoid 24*a*, dropping the pressure in cavity 61*a*. This will allow spring 74 to shift spool 50 downwardly, blocking flow to motor 20*a*. Slowing or stopping the trencher will decrease the load on digging chain 16*a* until the engine RPM returns to its standard level 38*a*. As the RPM begins to exceed the standard, the control system 10 again allows the trencher to increase its speed. The amount of voltage supplied to solenoid 24*a* is directly proportional to the amount of flow allowed to pass to motor 20*a*.

In place of the fixed displacement pump 18*a* and valve 22*a*, a variable displacement pump could be utilized. The signal from the control 40*a* would go to the pump stroke controller rather than the valve 22*a*.

Changes may be made in the construction and arrangement of the parts or elements of the embodiments as disclosed herein without departing from the spirit or scope of the invention as defined in the following claims.

I claim:

1. A trencher control system which varies the vehicle drive speed so as to maintain a preset torque on the digging chain as the digging conditions vary, comprising:

a prime mover;

a drive means connecting the prime mover to the digging chain;

a pump means driven by the prime mover;

a vehicle drive motor connected to the drive wheels of the trencher, said motor being driven by said pump;

RPM sensing means on the prime mover;

a servo-controlled valve means between the pump means and the vehicle drive motor which varies the amount of flow from the pump means to the drive motor; and an electronic control means which controls the servo of the valve means, the control means receives a signal from the RPM sensing means and compares the signal with an adjustable reference, if the signal received is less than the reference, the control means signals the servo to decrease the flow to the vehicle drive motor, if the signal is greater than the reference, the control means signals the servo to increase the flow to the drive motor and further load the prime mover, whereby the control means maintains the prime mover at its peak torque output regardless of changes in load.

2. A trencher control system as set forth in claim 1, wherein the drive means includes a second pump means driven by the prime mover and a digging chain drive motor hydraulically driven by said second pump.

3. A trencher control system as set forth in claim 1, wherein the pump means is a fixed displacement pump and the valve means returns to reservoir that portion of the pump flow not sent to the vehicle drive motor.

4. A trencher control system as set forth in claim 1, wherein the valve means includes a spring-biased unloading spool which dumps to reservoir all flow above a set pressure differential, a variable flow spool positioned downstream from the unloading spool spring-biased to a closed position, and a servo means acting against the spring of the variable flow spool to set the amount of flow to the drive motor.

5. A trencher control system as set forth in claim 1, wherein the valve means includes a spring-biased unloading spool which dumps to reservoir all flow when the valve inlet pressure exceeds valve outlet pressure by a set differential, a variable flow spool positioned downstream from the unloading spool spring-biased to a closed position, and a servo means acting against the spring of the variable flow spool to set the amount of flow to the drive motor.

6. A trencher control system as set forth in claim 1, wherein the valve means includes a spring-biased unloading spool which dumps to reservoir all flow when the valve inlet pressure exceeds valve outlet pressure by a set differential, a variable flow spool positioned downstream from the unloading spool spring-biased to a closed position, and a servo means acting against the spring of the variable flow spool to set the amount of flow to the drive motor; the servo means including a spool bore cavity exposed to one end of the variable flow spool, a restricted pilot flow path connecting the pressure upstream from the variable flow spool to said cavity and then to drain and a solenoid controlled variable orifice in the pilot flow path positioned downstream from said cavity whereby the pressure in the cavity can be controlled.

7. A horsepower control system on a working vehicle which varies the vehicle drive speed so as to maintain a preset torque output on the working function of the vehicle comprising:

a prime mover;

a drive means connecting the prime mover to the working function;

a pump means driven by the prime mover;

a vehicle drive motor connected to the drive wheels of the vehicle, said motor being driven by said pump;

RPM sensing means on the prime mover;

a servo-controlled valve means between the pump means and the vehicle drive motor which varies the amount of flow from the pump means to the drive motor; and an electronic control means which controls the servo of the valve means, the control means receives a signal from the prime mover sensing means and compares said signal with an adjustable reference, if the signal received is less than the reference, the control means signals the servo to decrease the flow to the vehicle drive motor, while if the prime mover signal is greater than the reference, the control means signals the servo to increase the flow to the drive motor and further load the prime mover, whereby the control means maintains the prime mover at its peak torque output.

* * * * *